US009574319B2

(12) United States Patent
Seljestad

(10) Patent No.: US 9,574,319 B2
(45) Date of Patent: Feb. 21, 2017

(54) POSITIVE INDICATOR FOR COUPLERS

(71) Applicant: CATERPILLAR INC., Peoria, IL (US)

(72) Inventor: Greg Seljestad, Wamego, KS (US)

(73) Assignee: Caterpillar Inc., Peoria, IL (US)

( * ) Notice: Subject to any disclaimer, the term of this patent is extended or adjusted under 35 U.S.C. 154(b) by 369 days.

(21) Appl. No.: 14/456,374

(22) Filed: Aug. 11, 2014

(65) Prior Publication Data

US 2016/0040387 A1 Feb. 11, 2016

(51) Int. Cl.
*E02F 3/36* (2006.01)
*E02F 9/26* (2006.01)

(52) U.S. Cl.
CPC ..... *E02F 3/3604* (2013.01); *E02F 3/364* (2013.01); *E02F 3/3627* (2013.01); *E02F 9/26* (2013.01)

(58) Field of Classification Search
CPC ..... E02F 3/3604; E02F 3/3609; E02F 3/364; E02F 3/3663; E02F 3/3627; Y10T 403/20
See application file for complete search history.

(56) References Cited

U.S. PATENT DOCUMENTS 5,010,962 A 4/1991 Bloom, Jr.
5,692,855 A 12/1997 Burton
6,139,212 A * 10/2000 Heiple ..... E02F 3/3618 37/398
7,275,909 B2 10/2007 Vigholm et al.
8,112,914 B2 2/2012 Miller et al.
2002/0064446 A1* 5/2002 Dvorak ..... E02F 3/3627 414/723
2006/0245898 A1* 11/2006 Diaz ..... E02F 3/3627 414/686
2010/0247228 A1 9/2010 Monaghan et al.

FOREIGN PATENT DOCUMENTS

FR 2631052 A1 * 11/1989 ..... E02F 3/3622
FR CA 2674514 A1 * 2/2010 ..... E02F 3/3622

* cited by examiner

*Primary Examiner* — Daniel P Stodola
*Assistant Examiner* — Jonathan Masinick
(74) *Attorney, Agent, or Firm* — Procopio, Cory, Hargreaves & Savitch LLP

(57) ABSTRACT

A retaining mechanism having a retainer member, plunger member, and an engagement indication assembly. The retainer member has a body that defines a void having a first end and a second end and extending along a length of the body. The plunger member is located at least partially in the void and has a length greater than the length of the void. The plunger member is movable a first position in which a portion of the plunger member extends beyond an end of the void, and a second position in which another portion of the plunger member extends beyond another end of the void. The engagement indication assembly includes a retainer member linkage coupled to the retainer member, a plunger member linkage coupled to the plunger member, and a flag member coupled to the plunger member linkage and the retainer member linkage.

20 Claims, 8 Drawing Sheets

POSITIVE INDICATOR FOR COUPLERS

TECHNICAL FIELD

The present disclosure relates to an implement system and more particularly to a coupler indication assembly to indicate a coupling status of an implement with the coupler.

BACKGROUND

Some machines associated with mining, agriculture, forestry, construction, and other industrial applications may have a coupler that allows various implements or tools to be coupled and decoupled to the machine. Theses couplers may have a support frame and a retaining mechanism to allow a quick connection with the implement. An operator may couple and/or decouple the implement using one or more controls disposed in the operator cabin. However, during coupling of the implement, the operator may sometimes not be able to fully view both components and the support frame may not be properly aligned with the implement. This misalignment and/or partial coupling may lead to faster or uneven wear of the components and may require more frequent servicing and/or replacement of the implement and/or the coupler. Thus, the operator may be required to exit the operator cabin and confirm alignment and/or the coupling of the implement to the coupler before operating the equipment. In some situations, the operator may attempt to confirm coupling by moving or shake the implement system, which may result in damage to the machine or implement if the implement is not fully coupled.

U.S. Pat. No. 5,692,855 discloses a coupler attached to the boom of a tractor or other vehicle that enables the boom to be connected to an implement such as a loader bucket. The coupler includes spring-loaded and laterally shiftable pins which latch to the implement when the coupler is shifted forward toward the implement. Unlatching of the pins is effected by manually turning an operating handle. The operating handle is connected to the pins by laterally rigid links which cause movement of the handle to follow movement of the pins in all positions of the pins so that the position of the handle serves as a visual indicator as to whether the pins are latched or unlatched.

SUMMARY OF THE DISCLOSURE

In one embodiment of the present application, a retaining mechanism for a coupler of a machine is described. The retaining mechanism includes a retainer member, a plunger member, and an engagement indication assembly. The retainer member has a body that defines a void having a first end and a second end and extends along a length of the body. The plunger member is located at least partially in the void and has a length greater than the length of the void. The plunger member is movable within the void between a first position in which a first portion of the plunger member extends beyond the first end of the void, and a second position in which a second portion of the plunger member extends beyond the second end of the void. The engagement indication assembly includes a retainer member linkage, a plunger member linkage, and a flag member. The retainer member linkage is coupled to the retainer member and the plunger member linkage is coupled to the plunger member. The flag member is coupled to both the plunger member linkage and the retainer member linkage. The plunger member linkage and the retainer member linkage are configured to move the flag member to a first position indicative of engagement based on the plunger member being in the first position and move the flag member to a second position indicative of non-engagement based on the plunger member being in the second position.

In another embodiment of the present application, a coupler for attaching an implement to a machine is described. The coupler includes a mounting structure, an actuator, and a retaining mechanism. The mounting structure includes a frame and the actuator is rigidly coupled to the frame of the mounting structure. The retaining mechanism includes a retaining member, a plunger member, and an engagement indication assembly. The retainer member is coupled to the actuator and is configured to be moved relative to the frame of the mounting structure by the actuator. The retainer member has a body that defines a void having a first end and a second end and extends along a length of the body. The plunger member is located at least partially in the void and has a length greater than the length of the void. The plunger member is movable between a first position in which a first portion of the plunger member extends beyond the first end of the void, and a second position in which a second portion of the plunger member extends beyond the second end of the void. The engagement indication assembly includes a flag member coupled to the retainer member and the plunger member. The flag member is configured to interact with the plunger member to move to a first position indicative of engagement based on the plunger member being in the first position and a second position indicative of non-engagement based on the plunger member being in the second position.

In another embodiment of the present application, an implement system for a machine is described. The system includes an implement, and a coupler. The implement has a material handling portion and a retainer engaging portion extending from the material handling portion. The coupler is configured to be mounted on the machine. The coupler includes a mounting structure, an actuator, and a retaining mechanism. The mounting structure includes a frame and the actuator is rigidly coupled to the frame of the mounting structure. The retaining mechanism includes a retainer member, a plunger member, and an engagement indication assembly. The retainer member is coupled to the actuator and is configured to be moved by the actuator relative to the frame to selectively engage the retainer engaging portion of the implement. The retainer member has a body defining a void having a first end and a second end and extending along the length of the body. The plunger member is located at least partially in the void and has a length greater than the length of the void. The plunger member is movable between a first position in which a first portion of the plunger member extends beyond the first end of the void, and a second position in which a second portion of the plunger member extends beyond the second end of the void. At least one of the first portion and the second portion of the plunger member contact the retainer engaging portion of the implement when the retainer member engages the retainer engaging portion. The engagement indication assembly includes a flag member coupled to the retainer member and the plunger member. The flag member is configured to interact with the plunger member to move to a first position indicative of engagement based on the plunger member being in the first position and a second position indicative of non-engagement based on the plunger member being in the second position.

DETAILED DESCRIPTION

Figure 1:
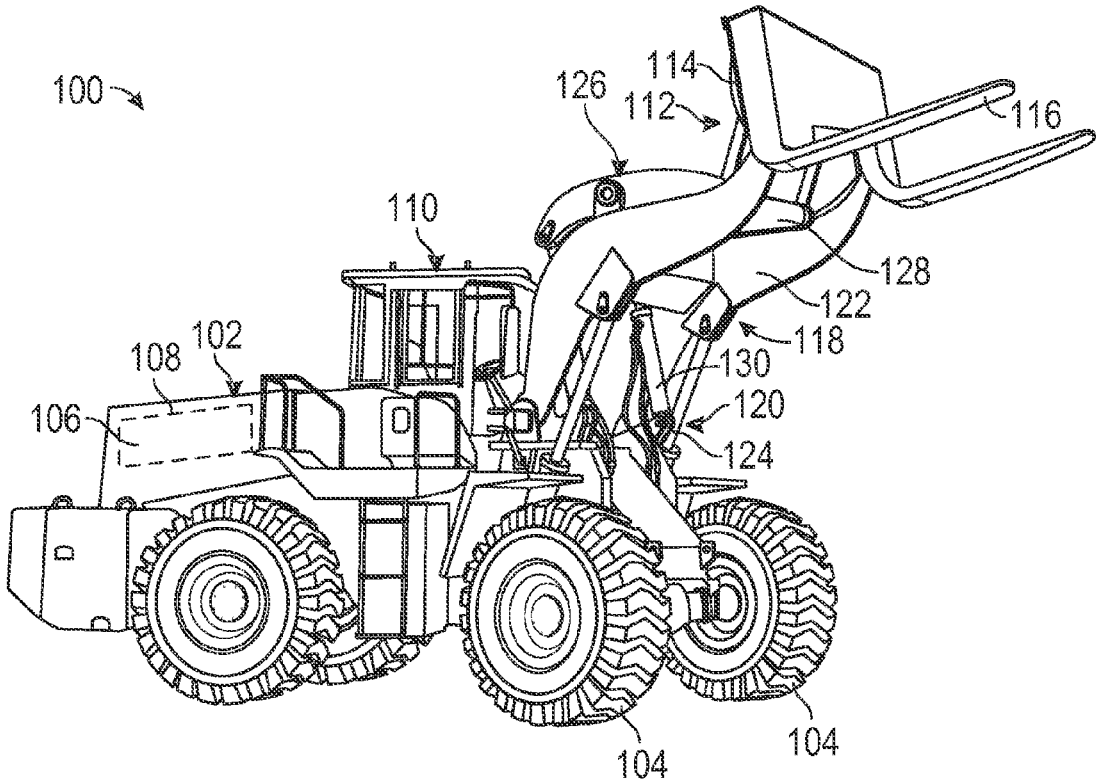
FIG. 1 illustrates a perspective view of an example machine.

The present disclosure relates to an implement system and more particularly to a coupler indication assembly to indicate a coupling status of an implement with the coupler. References will now be made in detail to specific embodiments or features, examples of which are illustrated in the accompanying drawings. Wherever possible, the same reference numbers will be used throughout the drawings to refer to the same or like parts. FIG. 1 illustrates an exemplary machine 100. In an embodiment, the machine 100 is illustrated as a wheel loader. In various alternative embodiments, the machine 100 may be any machine such as, a backhoe loader, a track type tractor, a compactor, an excavator, a skid steer loader, or any other agricultural, mining or construction machinery.

As illustrated in FIG. 1, the machine 100 may include a chassis 102. A set of ground engaging members 104, such as wheels or tracks, may also be provided on the machine 100 for the purpose of mobility. A powertrain or a drivetrain (not shown) may be provided on the machine 100 for the production and transmission of a motive power. The powertrain may include a power source 106 that may be located within an enclosure 108 and supported on the chassis 102 of the machine 100. The power source 106 may embody an internal combustion engine such as, for example, a diesel engine, a gasoline engine, a gaseous fuel powered engine, or any other type of engine apparent to one skilled in the art. The power source 106 may alternatively or additionally include a non-combustion source of power such as a fuel cell, a power storage device, an electric motor, or other similar mechanism. The powertrain may further include a torque converter, transmission inclusive of gearing, drive shaft and other known drive links provided between the power source 106 and the set of ground engaging members 104 for the transmission of the motive power.

The machine 100 includes an operator cab 110 which houses controls and/or operator display devices (not shown) for operating and/or monitoring the machine 100. Operator display device may be one of a liquid crystal display (LCD), a cathode ray tube (CRT), a personal digital assistant (PDA), a plasma display, a touchscreen, a monitor, a portable hand-held device, or any other display known in the art.

As shown in FIG. 1, the machine 100 includes an implement system 112. The implement system 112 includes a coupler 114 and an implement 116 removably attached to the coupler 114. The implement system 112 may be moved upwards and downwards and/or tilted in order to perform various operations. In the illustrated embodiment, the implement 116 is embodied as a fork to lift, carry, and dump a variety of materials. However, in other embodiments the implement 116 may include, but not limited to, a bucket, a shovel, or a blade to perform various operations.

The machine 100 may have a linkage assembly 118 attached to the chassis 102. The implement system 112 may be connected to the chassis 102 of the machine 100 by the linkage assembly 118 that may be configured to move the implement system 112. The kinematic arrangement of various elements in the linkage assembly 118 may control a lift and a tilt movement of the coupler 114 and thus controls the movement of the implement 116 attached thereto. In an embodiment, the linkage assembly 118 includes a lifting arrangement 120 for controlling the upward and downward movement of the implement 116. The lifting arrangement 120 includes a lift arm 122 coupled to the chassis 102 by means of one or more pivot connections. One or more lift cylinders 124 may be operatively coupled to the lift arms 122 and provide an actuation force for an upward and downward movement of the implement system 112. As illustrated, two lift arms 122 may be provided, with each having corresponding lift cylinders 124. However, a single lift arm 122 driven by a single lift cylinder 124, two lift arms 122 driven by the single lift cylinder 124, or other arrangements of the lift arms 122 and the lift cylinders 124 may be contemplated within the scope of the present disclosure. The lift cylinder 124 may be extended to raise the lift arm 122 and retracted to lower the lift arm 122 and hence effect the lift movement of the implement 116.

The tilt movement of the implement 116 is controlled by a tilting arrangement 126, in the linkage assembly 118. The tilting arrangement 126 may include one or more tilt arms 128. One or more tilt cylinders 130 may be coupled to the tilt arm 128 to provide an actuation force for the tilt movement of the implement 116. The lift cylinder 124 and the tilt cylinder 130 are hydraulic cylinders driven by a pump using a pressurized hydraulic fluid, or alternatively may be some other kind of actuators such as a pneumatic linear actuators, electro-mechanical actuators, or the like. Further, it may be noted that the linkage assembly 118 and the implement 116 of the machine 100 may vary based on the type of machine 100 or the type of operation or task required to be carried out by the machine 100.

Figure 2:
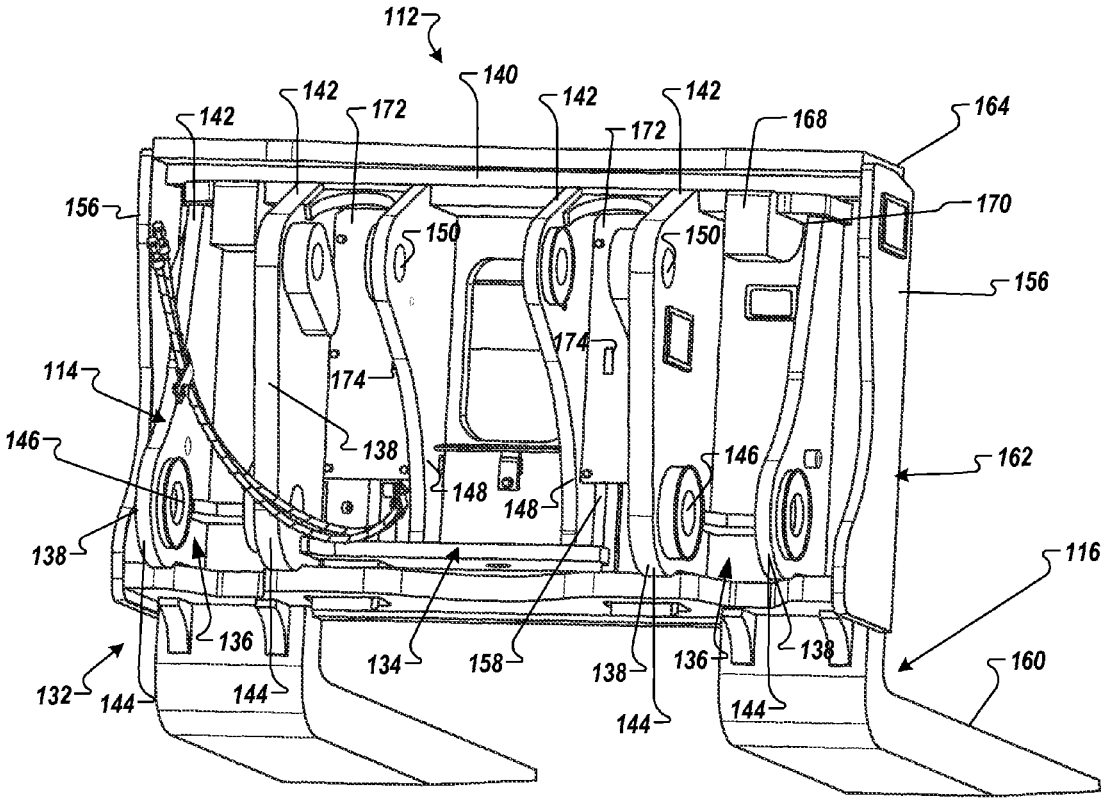
FIG. 2 illustrates a perspective view of an example embodiment of an implement system associated with the machine of FIG. 1.

FIG. 2 illustrates a perspective view of an example embodiment of an implement system 112 associated with the machine of FIG. 1. According to an example embodiment, the coupler 114 includes a mounting structure 132. The mounting structure 132 includes a frame 134 and an attachment part 136 rigidly attached to the frame 134. The attachment part 136 attaches the coupler 114 to the linkage assembly 118 of the machine 100. The attachment part 136 may include pairs of spaced apart plates, such as primary plates 138 rigidly attached to the frame 134. The primary plates 138 are supported by a plate member 140 extending transversely from the frame 134. The primary plates 138 include a top end 142 and a bottom end 144. The top end 142 of the primary plates 138 is rigidly attached to the plate member 140. The bottom end 144 defines a set of aligned primary openings 146 to attach the lift arm 122 of the linkage assembly 118 with the coupler 114.

In some embodiments, a compartment (or chamber) 158 may be formed between the one of the primary plates 138, one of the secondary plates 148. In some embodiments, a faceplate 172 may enclose the compartment 158. In some embodiments, the faceplate 172 may be attached to the primary plate 138 and/or the secondary plate 148. Further, in some embodiments, the faceplate 172 may have an indicator window 174 formed therein. As discussed in greater detail below with respect to FIG. 3 below, the compartment 158 may house a retaining mechanism 180 (illustrated in FIG. 3 below) and an indication assembly 212 (illustrated in FIGS. 5-10 below). In this embodiment, one compartment (or chamber) 158 is illustrated. However, embodiments of the present application may include multiple compartments (or chambers) 158 located in different areas of the coupler 114, each coupler housing its own retaining mechanism 180 and indication assembly 212 and covered by its own faceplate 172 with an indicator window 174.

In some example embodiments, the attachment part 136 may further include another pair of spaced apart secondary plates 148 having a set of aligned secondary openings 150 to attach with the tilt arm 128 of the linkage assembly 118. In an embodiment, the set of aligned primary openings 146 and secondary openings 150 may be a set of bossed openings as commonly known in the art. In the illustrated embodiment, the coupler 114 includes two pairs of primary plates 138 disposed on either side of the frame 134 and configured to attach to the pair of lift arms 122 of the linkage assembly 118. The pair of secondary plates 148 is disposed substantially between the pair of primary plates 138 and is configured to attach the tilt arm 128 of the linkage assembly 118 with the machine 100.

As should be apparent to a person having ordinary skill in the art, positioning of the primary openings 146 and the secondary openings 150, and their method of attachment to the lift arms 122 and the tilt arms 128 as discussed herein are merely exemplary in nature and thus non-limiting to this disclosure. One may contemplate other suitable positions for the primary openings 146 and the secondary openings 150, and other suitable means for attaching them to the lift arms 122 and the tilt arms 128 to allow movement of the coupler 114 and the implement 116 attached thereto.

The implement 116 includes a material handling portion 160 and a coupler attachment portion 162 extending from the material handling portion 160. In some embodiments, the material handling portion 160 may include a pair of forks. In other embodiments, the material handling portion 160 may include a bucket or any other type of material handling portion 160 that may be apparent to a person of ordinary skill in the art. The coupler attachment portion 162 may include a top surface plate 164 and one or more side plates 156. A flange 166 (not illustrated in FIG. 2, labeled in FIG. 3) may also extend downward from the top surface plate 164 of the coupler attachment portion 162. The implement 116 may further includes a collar 168 extending from the flange 166 (not illustrated in FIG. 2, labeled in FIG. 3) such that the collar 168 and the flange 166 of the coupler attachment portion 162 define a receptacle 170 therebetween. As shown in FIG. 2, the plate member 140 associated with the frame 134 of the coupler 114 may be engaged within the receptacle 170 provided on the implement 116.

Figure 3:
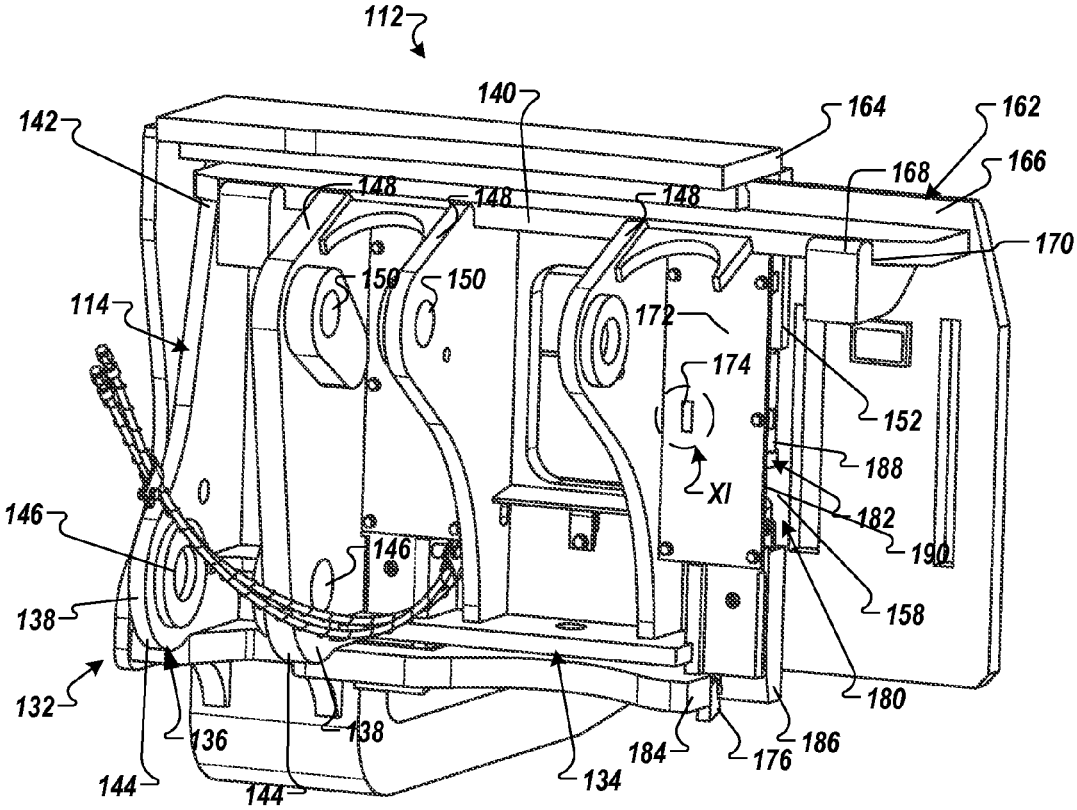
FIG. 3 illustrates a perspective view of the example embodiment of implement system of FIG. 1 with a portion of the frame removed.

FIG. 3 illustrates a perspective view of the example embodiment of implement system 112 of FIG. 1 with a portion of the frame 134, including one of the primary plates 138, removed to illustrate the interior of the compartment 158. As discussed above, the compartment 158 is enclosed by one of the secondary plates 148, one of the primary plates 138 (removed in FIG. 3), and the faceplate 172. As illustrated in FIG. 3, the coupler 114 further includes a retaining mechanism 180. The retaining mechanism 180 includes an actuation system 182 rigidly coupled to the mounting plate 152. The retaining mechanism 180 further includes a retainer member 186 operatively connected to the actuation system 182 and configured to selectively engage a retainer engaging portion 184 disposed at a lower end of the coupler attachment portion 162.

As illustrated, the retainer engaging portion 184 is formed as a lower plate having an opening formed therein through which the retainer member 186 is inserted and includes a plunger member engaging surface 176, which will be discussed in greater detail below. However, example embodiments of the present application are not limited to this configuration and may include alternate configurations is me be apparent to a person of ordinary skill in the art.

In the illustrated embodiment, the retaining mechanism 180 is disposed in the cavity 158 such that a retainer member 186 may be selectively movable into the retainer engaging portion 184 by the actuation system 182. The actuation system 182 may include a cylinder 188 and a piston 190 moveably mounted within the cylinder 188. The cylinder 188 may be rigidly coupled to the mounting plate 152. In some embodiments, the cylinder 188 may be a hydraulically or a pneumatically actuated cylinder as may be apparent to a person of ordinary skill in the art. However, embodiments of the present application are not limited to actuation systems 182 having hydraulically or pneumatically actuated cylinders 188, and may have other configurations of actuation systems 182 such as electric actuators, mechanical actuators, or any other type of actuator as may be apparent to a person of ordinary skill in the art.

Figure 4:
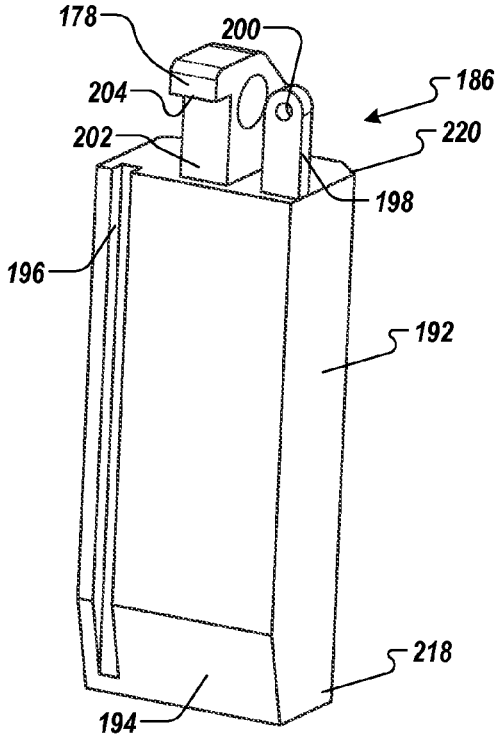
FIG. 4 illustrates an example embodiment of a retainer member used in the implement system of FIG. 3.

FIG. 4 illustrates an example embodiment of a retainer member 186 used in the implement system 112 of FIG. 3. The retainer member 186 has a body 192 with a void 196 extending along substantially all of its length. In this embodiment, the body 192 of the retainer member 186 is shaped as a rectangular prism having a lower portion 218 and an upper and 220. Further, the body 192 also has an angled portion 194 formed at the lower portions 218 giving the body 192 a wedge-like shape. As illustrated in the void 196 is formed as a groove in the surface of the body 192. However, embodiments of the body 192 and the void 196 are not limited to the configuration illustrated in FIG. 4 and may have other configurations that may be apparent to a person of ordinary skill in the art. For example, the body 192 may be formed as a cylindrical prism and the void 196 may alternatively be formed as a transverse hole extending along the length of the body.

The retainer member 186 also includes a linkage attachment portion 198 and an upper support portion 202. The linkage attachment portion 198 may include a connection point 200 that may be used to connect the attachment portion 198 of the retainer member 186 to a linkage of the indication assembly 212 (illustrated in FIGS. 5-10, discussing greater detail below). The upper support portion 202 extends upward from the retainer member 186 and has a lip portion 178 with a resilient member retaining hole 204 formed in the lower surface of the lip portion 178.

Figure 5:
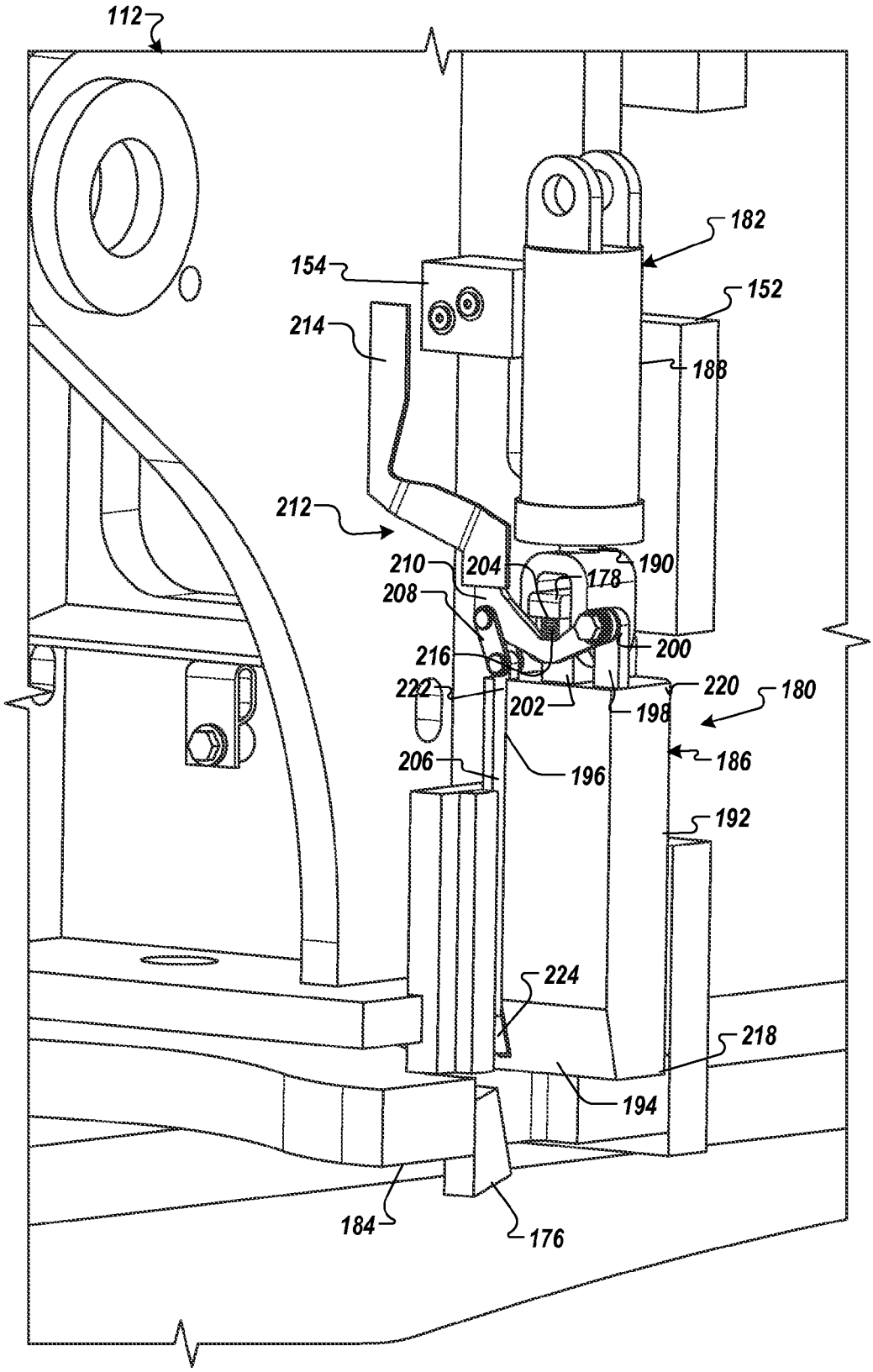
FIG. 5 illustrates a perspective view of the implement system as illustrated in FIG. 3 with the faceplate removed to show an example embodiment of a retaining mechanism in a first position.

FIG. 5 illustrates an enlarged, perspective view of the implement system 112 as illustrated in FIG. 3 with the faceplate 172 removed to show an example embodiment of a retaining mechanism 180 in a first position.

As illustrated, the actuator cylinder 188 is connected the mounting plate 152 by a support portion 154. Further, the actuator piston 190 is connected to the retainer member 186 via upper support portion 202. The retainer member 186 moves upward and downward as the actuator piston 190 moves relative to the actuator cylinder 188. In FIG. 5, the retainer member 186 as illustrated in an upper position and the actuator piston 190 is illustrated retracted into the actuator cylinder 188.

In FIG. 5, the retaining mechanism 180 is includes a plunger member 206 inserted into the void (groove) 196 formed in the body 192 of the retainer member 186. The plunger member 206 to be movable within the void 196 relative to the retainer member 186. The plunger member 206 includes a first (upper) portion 222, and a second (lower) portion 224, and also has a length longer than a length of the void 196 in the retainer member 186. Therefore, a portion of the plunger member 206 extends beyond an end of the void 196 in the retainer member 186.

In FIG. 5, the retaining mechanism 180 is also shown connected to an indication assembly 212. The indication assembly 212 includes a flag member 214 connected to the plunger member 206 and retainer member 186 by a pair of linkages 208, 210. Specifically, the plunger member linkage 208 is illustrated connecting the flag member 214 to the plunger member 206. Further, the retainer member linkage 210 is illustrated connecting to the connection point 200 of the linkage attachment portion 198 of the retainer member 186. The plunger member linkage 208 and the retainer member linkage 210 may cause the flag member 214 to move based on the relative position of the retainer member 186 and the plunger member 206. Further, a resilient member 216 may be positioned between the retainer member linkage 210 and the lip portion 178 of the upper support portion 202 to bias the flag member 214 toward the first position illustrated in FIG. 5. This first position may be located away from the indicator window 174 formed in the faceplate 172 (illustrated in FIGS. 2 and 3 above) such that the flag member 214 is not visible through the indicator window 174 when in the second position.

Figure 6:
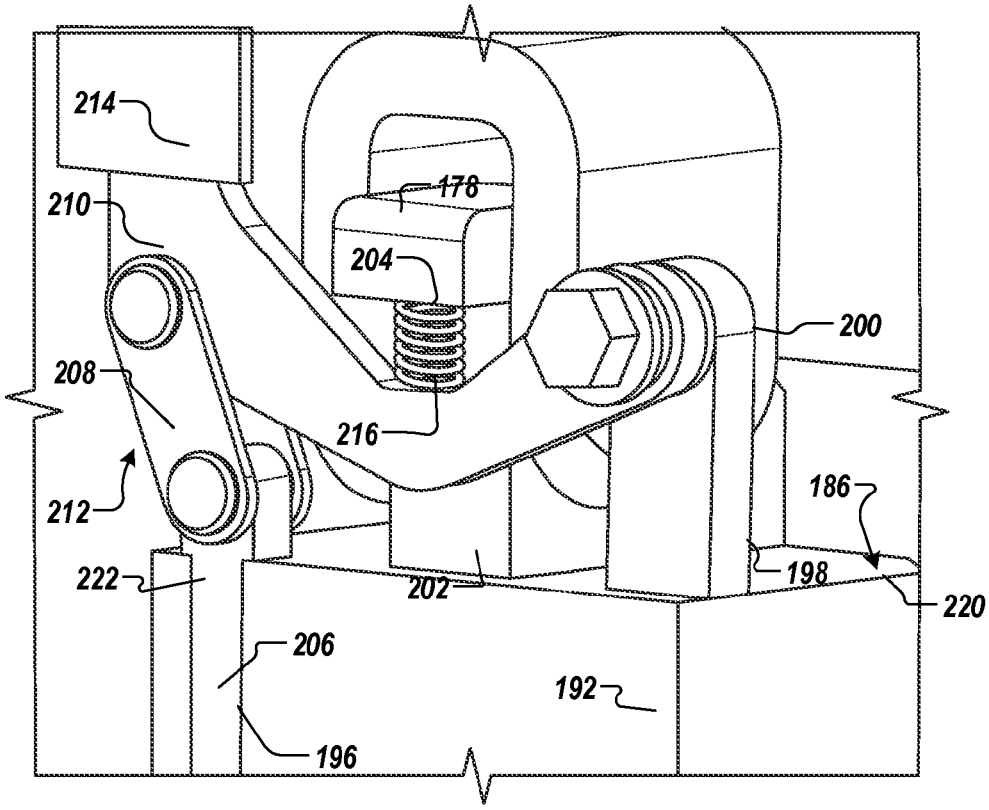
FIGS. 6 and 7 illustrate enlarged views of portions of the retaining mechanism in the first position of FIG. 5.
Figure 11:
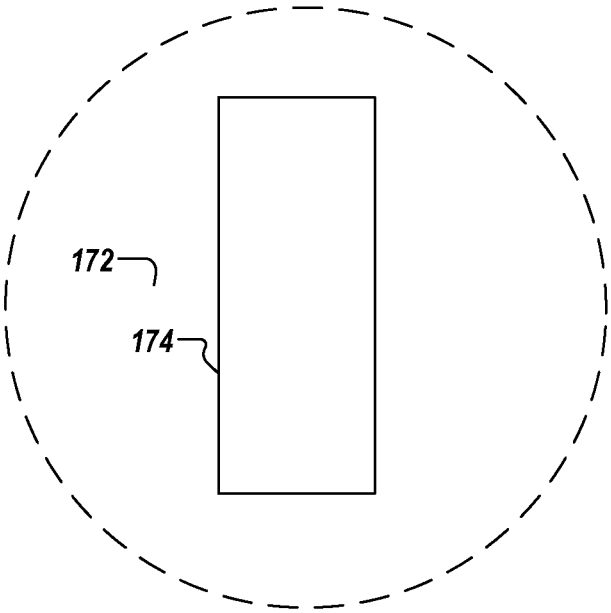
FIGS. 11 and 12 illustrate a portion of FIG. 3 showing the indicator window 174 during various positions of a flag member 214 associated with the engagement indication assembly 212.

FIG. 6 illustrate an enlarged view of a portion of the retaining mechanism 180 showing the upper portion 220 of the retainer member 186 in the first position of FIG. 5. As illustrated, the upper portion 222 of the plunger member 206 contacts the retainer member 186 at the upper portion 220 of the retainer member 186. This relative position between the retainer member 186 and the plunger member 206 causes the plunger member linkage 208 and the retainer member linkage 210 to position the flag member 214 in the first position away from the indicator window 174 (illustrated in FIGS. 2 and 3 above) so as to not be visible there through as illustrated in FIG. 11 below.

Figure 7:
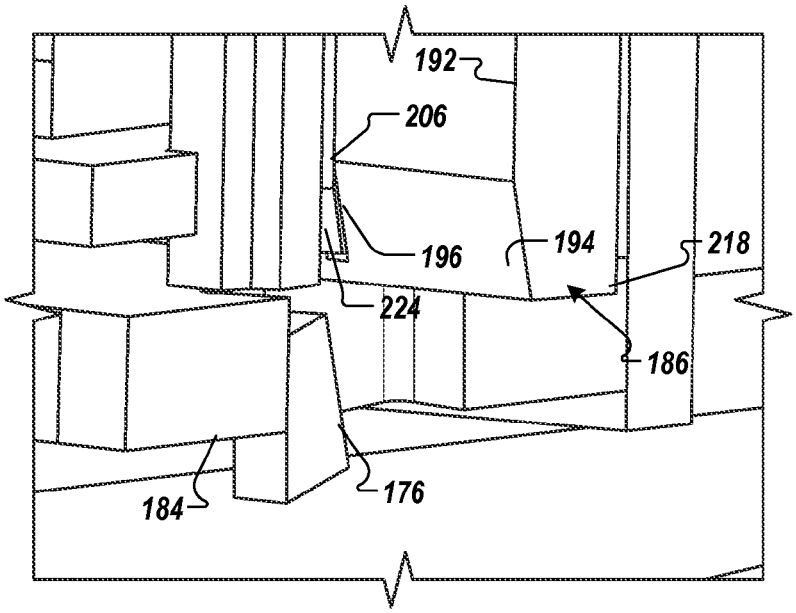

FIG. 7 an enlarged view of a portion of the retaining mechanism 180 showing the lower portion 218 of the retainer member 186 in the first position of FIG. 5. As illustrated, the lower portion 224 of the plunger member 206 extends beyond the end of the groove 196 at the lower portion 218 of the retainer member 186.

Figure 8:
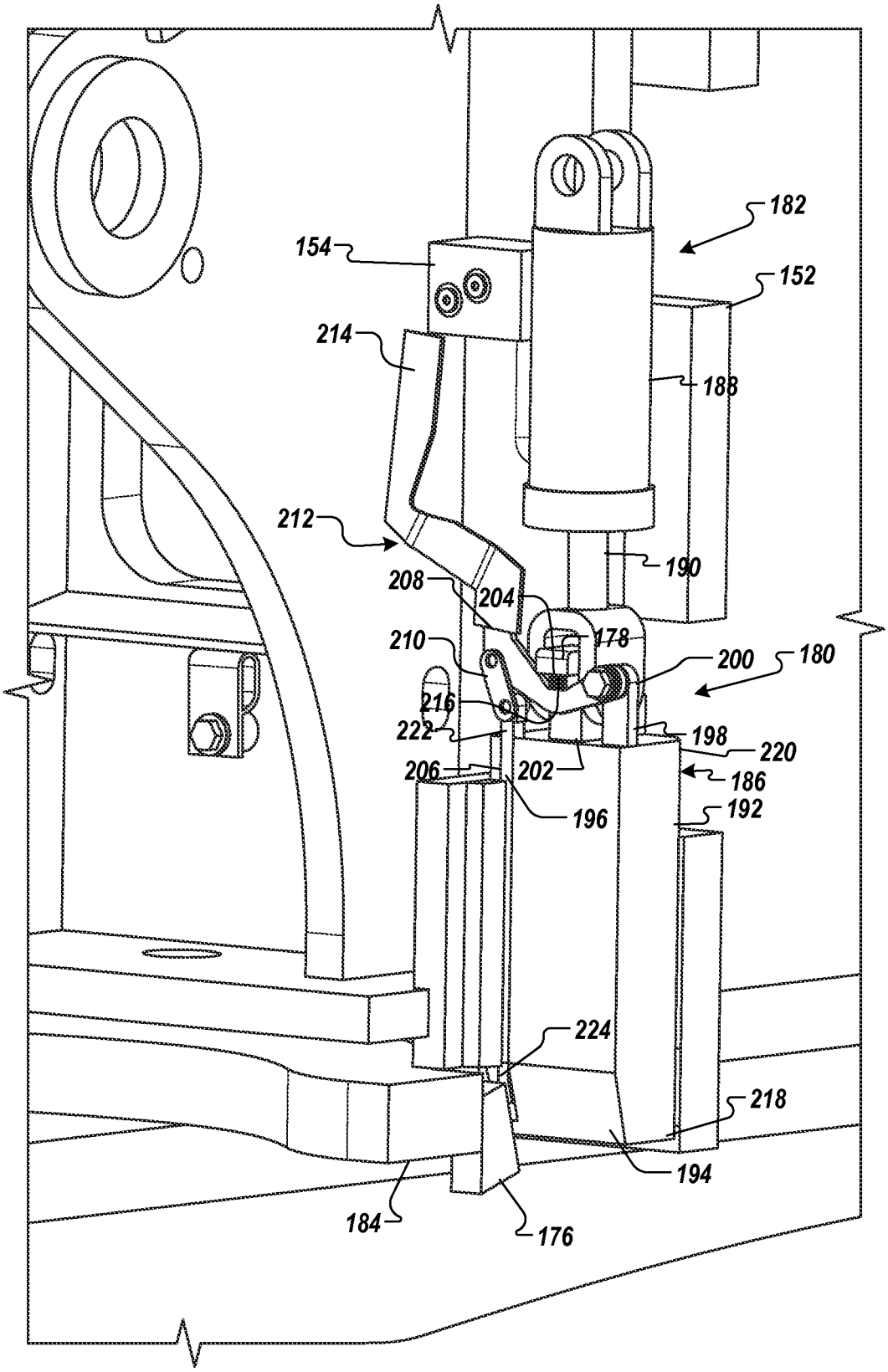
FIG. 8 illustrates a perspective view of the implement system as illustrated in FIG. 3 with the faceplate removed to show the example embodiment of the retaining mechanism in a second position.

FIG. 8 illustrates an enlarged, perspective view of the implement system 112 as illustrated in FIG. 3 with the faceplate 172 removed to show an example embodiment of a retaining mechanism 180 in a second position.

In FIG. 8, the retainer member 186 has moved from the upper position illustrated in FIG. 5 to a lowered position. As illustrated, the actuator piston 190 has been extended from the actuator cylinder 188 lowering the retainer member 186 to the lowered position. As further illustrated in FIG. 8 (and shown in larger view in FIGS. 9 and 10 discussed below), the downward movement of the retainer member 186 has caused the plunger member 206 to contact the plunger member engaging surface 176 of the retainer engaging portion 184. By contacting the plunger member engaging surface 176, the plunger member 206 has been moved upward relative to retainer member 186 and the relative movement between the plunger member 206 and the retainer member 186 has been translated to the flag member 214 by the plunger member linkage 208 and the retainer member linkage 210. The relative movement between the plunger member linkage 208 and the retainer member linkage 210 cause the flag member 214 to move from the first position illustrated in FIG. 5 to the second position illustrated in FIG. 8. This second position may be located behind the indicator window 174 formed in the faceplate 172 (illustrated in FIGS. 2 and 3 above) such that the flag member 214 is visible through the indicator window 174 when in the second position.

Figure 9:
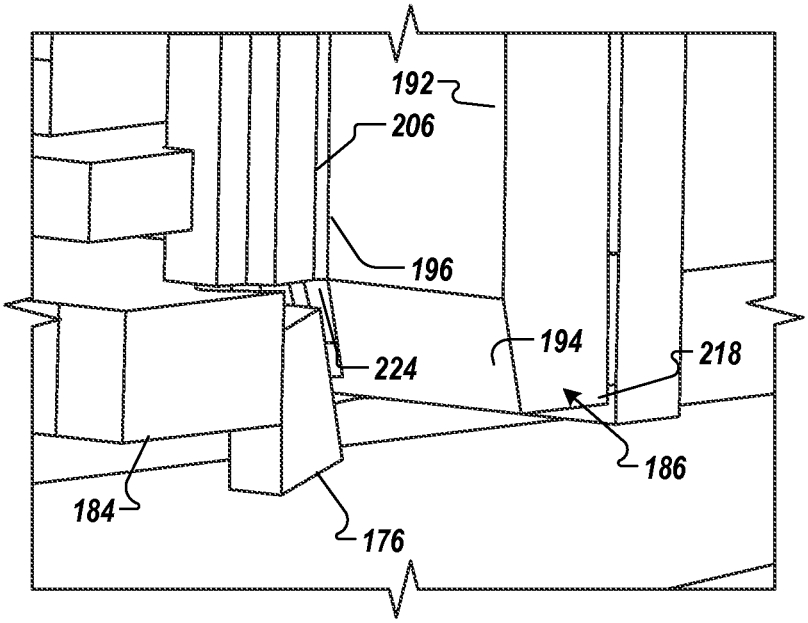

FIG. 9 an enlarged view of a portion of the retaining mechanism 180 showing the lower portion 218 of the retainer member 186 in the second position of FIG. 8. As illustrated, the lower portion 224 of the plunger member 206 has contacted the plunger member engaging surface 176 of the retainer engaging portion 184 and has been pushed upward relative to the retainer member 186.

Figure 10:
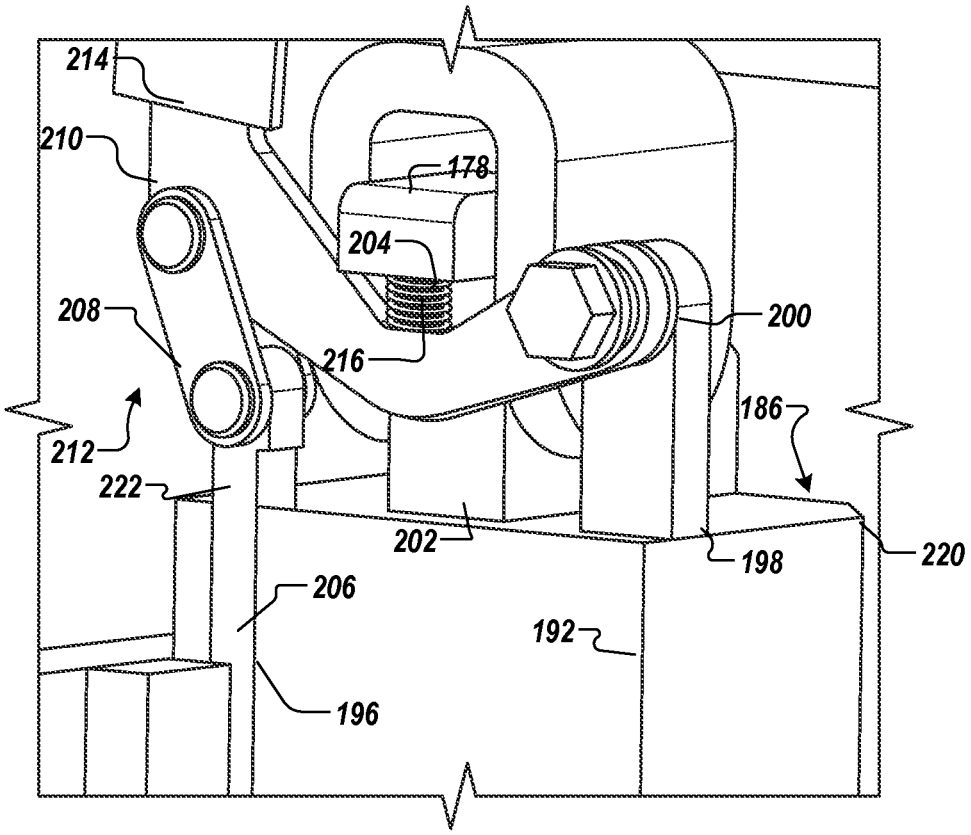
FIGS. 9 and 10 illustrate enlarged views of portions of the retaining mechanism in the second position of FIG. 8.

FIG. 10 illustrate an enlarged view of a portion of the retaining mechanism 180 showing the upper portion 220 of the retainer member 186 in the second position of FIG. 8. As illustrated, the upper portion 222 of the plunger member 206 extends beyond the end of the groove 196 at the lower portion 218 of the retainer member 186 because it has been pushed upward due to contact with the plunger member engaging surface 176 of the retainer engaging portion 184. This repositioning of the plunger member 206 relative to the retainer member 186 causes the plunger member linkage 208 and the retainer member linkage 210 to reposition the flag member 214 behind the indicator window 174 (illustrated in FIGS. 2 and 3 above) to be visible there through as illustrated in FIG. 12 below.

Figure 12:
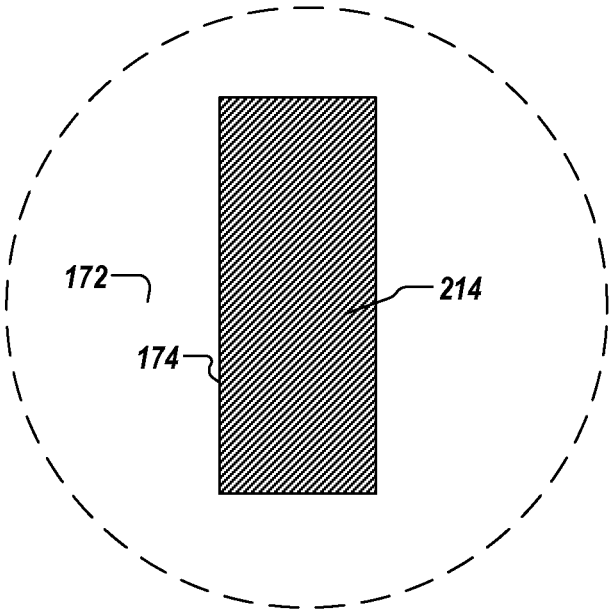

FIGS. 11 and 12 illustrate a portion of FIG. 3 showing the indicator window 174 during various positions of a flag member 214 associated with the engagement indication assembly 212. FIG. 11 illustrates the indicator window 174 of the faceplate 172 when the flag member 214 is in the first position discussed above with respect to FIGS. 5-7 and is not visible through the indicator window 174. FIG. 12 illustrates the indicator window 174 of the faceplate 172 when the flag member 214 is in the second position discussed above with respect to FIGS. 8-10 and is visible through the indicator window 174.

INDUSTRIAL APPLICABILITY

The industrial applicability of the implement system 112 for the machine 100 described herein will be readily appreciated from the foregoing discussion. Specifically, by allowing the different implements 116 to be attached to the machine 100 the versatility of the machine 100 can be increased. For example, a bucket implement may be used for some applications, detached and then a fork implement may be attached and used for other applications.

The operation of an embodiment of the implement system 112 may be illustrated with reference to FIGS. 2-12. As discussed above with respect to FIG. 2, the implement system 112 includes a coupler 114, which is attached to the machine 100 or more implements 116, which may be removably connected and disconnected from the coupler 114. More specifically, the coupler 114 is connected to the machine 100 by a mounting structure 132 having an attachment part 136 that attaches to the linkage assembly 118 of the machine 100. The attachment part 136 may include pairs of spaced apart plates, such as primary plates 138 having one or more sets of primary openings 146 that attach the lift arm 122 of the linkage assembly 118 the machine 100.

Further, the coupler 114 also includes a frame 134 having a plate member 140 which supports the primary plates 138 of the mounting structure 132. During engagement of the coupler 114 to the implement 116, the plate member 140 is engaged within a receptacle 170 forms on the coupler attachment portion 162 of the implement 116. Specifically, the coupler attachment portion 162 includes a flange 166 extending downward from a top surface plate 164 of the coupler attachment portion 162 and a collar 168 extending from the flange 166. The collar 168 and the flange 166 together form the receptacle 170 which receives the plate member 140 of the frame 134 of the coupler 114.

As illustrated in FIG. 3-10, the coupler 114 also includes a retaining mechanism 180 and an indication assembly 212 attached to one of the primary plates 138 and covered by a faceplate 172 having an indicator window 174. When the plate member 140 of the coupler 114 is engaged within the receptacle 170 of the coupler attachment portion 162 of the implement 116, the retaining mechanism 180 may engage a retainer engaging portion 184 of the coupler attachment portion 162. Specifically, an actuation system 182 may move a retainer member 186 downward into an opening formed in the retainer engaging portion 184, thereby locking the coupler attachment portion 162 to the coupler 114.

Further, the indication assembly 212 includes a flag member 214 attached to the retainer member 186 and the plunger member 206 by a retainer member linkage 210 and a plunger member linkage 208, respectively. When the retainer member 186 is in the upper (unlocked or non-engaged) position illustrated in FIGS. 5-7, the plunger member 206 is in a lowered position and a resilient member 216 causes the flag member 214 to be in a first position which is not visible (i.e. obscured) through the indicator window 174 formed in the faceplate 172 as illustrated in FIG. 11.

As the retainer member 186 is lowered (moved into a locked or engaged position) illustrated in FIG. 8-10, the plunger member 206 engages a plunger member engaging surface 176 of the retainer engaging portion 184 and is blocked and pushed upward through the retainer member 186. The relative movement of the plunger member 206 and the retainer member 186 causes the retainer member linkage 210 and the plunger member linkage 208 to move the flag member 214 into the second position, which is visible through the indicator window 174 formed in the faceplate 172 as illustrated in FIG. 12.

By providing an indication assembly 212 and a retaining mechanism 180 as discussed in the above embodiments, an operator of the machine 100 may be able visualize when the retainer member 186 and the plunger member 206 are in their proper positions of the coupler 114 (i.e. locked and engaged with the implement 116), based on the flag member 214 being visible through the indicator window 174 formed in the faceplate 172 without having to exit the operator cab 110 of the machine 100. In an embodiment having multiple retaining mechanisms 180 and multiple indication assemblies 212, an operator may be able to observe which retainer members 186 are engaged and which retainer members 186 are not engaged. If all of the retainer members 186 are indicated as being engaged, the implement 116 may be considered coupled to the coupler 114.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present application fully encompasses other embodiments that may become obvious to those skilled in the art and that the scope of the present application is accordingly limited by nothing other than the appended claims.

What is claimed is:

1. A retaining mechanism for a coupler of a machine, the retaining mechanism comprising:

a retainer member having a body, the body defining a void having a first end and a second end and extending along a length thereof;

a plunger member located at least partially in the void and having a length greater than the length of the void, the plunger member movable in the void between a first position in which a first portion of the plunger member extends beyond the first end of the void, and a second position in which a second portion of the plunger member extends beyond the second end of the void; and an engagement indication assembly including a retainer member linkage coupled to the retainer member;

a plunger member linkage coupled to the plunger member;

a flag member coupled to the plunger member linkage and the retainer member linkage, the plunger member linkage and the retainer member linkage configured to move the flag member to a first position indicative of engagement based on the plunger member being in the first position and move the flag member to a second position indicative of non-engagement based on the plunger member being in the second position.

2. The retaining mechanism of claim 1, wherein the body has a wedge shape including an angled surface formed at one of a first end and a second end of the body.

3. The retaining mechanism of claim 1, wherein the void defined by the body of the retainer member is a groove extending along the length of a surface of the body.

4. The retaining mechanism of claim 1, the engagement indication assembly further including a resilient member attached to the flag member and biasing the flag member to the second position.

5. A coupler for attaching an implement to a machine, the coupler comprising:

a mounting structure including a frame;

an actuator rigidly coupled to the frame of the mounting structure; and a retaining mechanism including a retainer member coupled to the actuator and configured to be moved relative to the frame of the mounting structure by the actuator, the retainer member having a body, the body defining a void having a first end and a second end and extending along a length thereof, a plunger member located at least partially in the void and having a length greater than the length of the void, the plunger member movable between a first position in which a first portion of the plunger member extends beyond the first end of the void, and a second position in which a second portion of the plunger member extends beyond the second end of the void, and an engagement indication assembly including a flag member coupled to the retainer member and the plunger member, the flag member configured to interact with the plunger member to move to a first position indicative of engagement based on the plunger member being in the first position and a second position indicative of non-engagement based on the plunger member being in the second position.

6. The coupler of claim 5, further including a faceplate mounted to the frame of the mounting structure and covering the retaining mechanism, the faceplate having an indicator window;

wherein the flag member is visible via the indicator window in one of the first position and the second position; and wherein the flag member is obscured by the faceplate in the other of the first position and the second position.

7. The coupler of claim 5, wherein the actuator is a hydraulic actuator configured to move the retainer member between a retracted position and an extended position.

8. The coupler of claim 5, wherein the body has a wedge shape including an angled surface formed at one of a first end and a second end of the body.

9. The coupler of claim 5, wherein the void defined by the body of the retainer member is a groove extending along the length of a surface of the body.

10. The coupler of claim 5, the engagement indication assembly further including a resilient member attached to the flag member and biasing the flag member to the second position.

11. An implement system for a machine, the system comprising:

an implement having a material handling portion, and a retainer engaging portion extending from the material handling portion;

a coupler configured to be mounted on the machine, the coupler including a mounting structure including a frame;

an actuator rigidly coupled to the frame of the mounting structure; and a retaining mechanism including a retainer member coupled to the actuator and configured to be moved by the actuator relative to the frame to selectively engage the retainer engaging portion, the retainer member having a body, the body defining a void having a first end and a second end and extending along a length thereof, a plunger member located at least partially in the void and having a length greater than the length of the void, the plunger member movable between a first position in which a first portion of the plunger member extends beyond the first end of the void, and a second position in which a second portion of the plunger member extends beyond the second end of the void, at least one of the first portion and the second portion of the plunger member contacting the retainer engaging portion when the retainer member engages the retainer engaging portion, and an engagement indication assembly including a flag member coupled to the retainer member and the plunger member, the flag member configured to interact with the plunger member to move to a first position indicative of engagement based on the plunger member being in the first position and a second position indicative of engagement based on the plunger member being in the second position.

12. The implement system of claim 11, wherein the retainer engaging portion includes a plate extending from the material handling portion forming an opening configured to receive the retaining mechanism.

13. The implement system of claim 11, wherein the retainer engaging portion includes a plunger member engaging surface configured to contact the plunger member and move the plunger member from the second position to the first position when the retainer member engages the retainer engaging portion.

14. The implement system of claim 11, wherein the retainer engaging portion further includes a plunger member engaging surface configured to block extension of the plunger member when the retainer member engages the retainer engaging portion and cause the plunger member to be pushed upward through the body of the retainer member into the first position.

15. The implement system of claim 11, wherein the implement is at least one of a bucket, and a fork.

16. The implement system of claim 11, further including a faceplate mounted to the frame of the mounting structure and covering the retaining mechanism, the faceplate having an indicator window;

wherein the flag member is visible via the indicator window in one of the first position and the second position; and wherein the flag member is obscured by the faceplate in the other of the first position and the second position.

17. The implement system of claim 11, wherein the actuator is a hydraulic actuator configured to move the retainer member between a retracted position and an extended position.

18. The implement system of claim 11, wherein the body has a wedge shape including an angled surface formed at one of a first end and a second end of the body.

19. The implement system of claim 11, wherein the void defined by the body of the retainer member is a groove extending along the length of a surface of the body.

20. The implement system of claim 11, the engagement indication assembly further including a resilient member attached to the flag member and biasing the flag member to the second position.

* * * * *